US005765874A

United States Patent [19]

Chanenson et al.

[11] Patent Number: 5,765,874

[45] Date of Patent: Jun. 16, 1998

[54] METHOD FOR MASS CUSTOMIZATION OF PRINTED MATERIALS

[75] Inventors: Cyndy B. Chanenson, Deerfield; David M. Clemens, Vernon Hills; Christopher C. Mills, Evanston, all of Ill.

[73] Assignee: Custom Creative Insights Corporation, Deerfield, Ill.

[21] Appl. No.: 437,851

[22] Filed: May 9, 1995

[51] Int. Cl.[6] ..... B42D 15/00

[52] U.S. Cl. ..... 283/67; 283/70; 283/74

[58] Field of Search ..... 283/67, 70, 74, 283/75, 900; 412/1; 281/15.1; 364/400, 479.05

[56] References Cited

U.S. PATENT DOCUMENTS

| | | |
|---|---|---|
| 3,892,427 | 7/1975 | Kraynak et al. . |
| 3,982,744 | 9/1976 | Kraynak et al. . |
| 4,616,327 | 10/1986 | Rosewarne et al. . |
| 5,114,291 | 5/1992 | Hefty . |
| 5,213,461 | 5/1993 | Kalisher . |

*Primary Examiner*—Willmon Fridie, Jr.
*Attorney, Agent, or Firm*—Fitch, Even, Tabin & Flannery

[57] ABSTRACT

A method for rapidly producing a high volume individually customized printed novelties containing printed text located within defined regions of text displays of various sizes and shapes. The method is particularly well-suited for the rapid mass production of customized or personalized comics or comic books. The method involves predetermining the location and maximum length of the variable text to be included in the text, providing paper stock containing art and the borders of text displays without text sized to accommodate the maximum length of the variable text strings, integrating and formatting the fixed and variable text so as to control excess spacing between the variable and surrounding text, and printing the integrated text within the blank text displays in a manner which controls spacing between the text and the borders of text displays. The method utilizes conventional printing equipment to generate the printed stock and an electronic computer printer to add the customized text. The necessary data manipulation, formatting and printing is controlled by customization software of the invention. Finally, the present invention permits offset adjustment of all text on a page through use of a single reference.

4 Claims, 18 Drawing Sheets

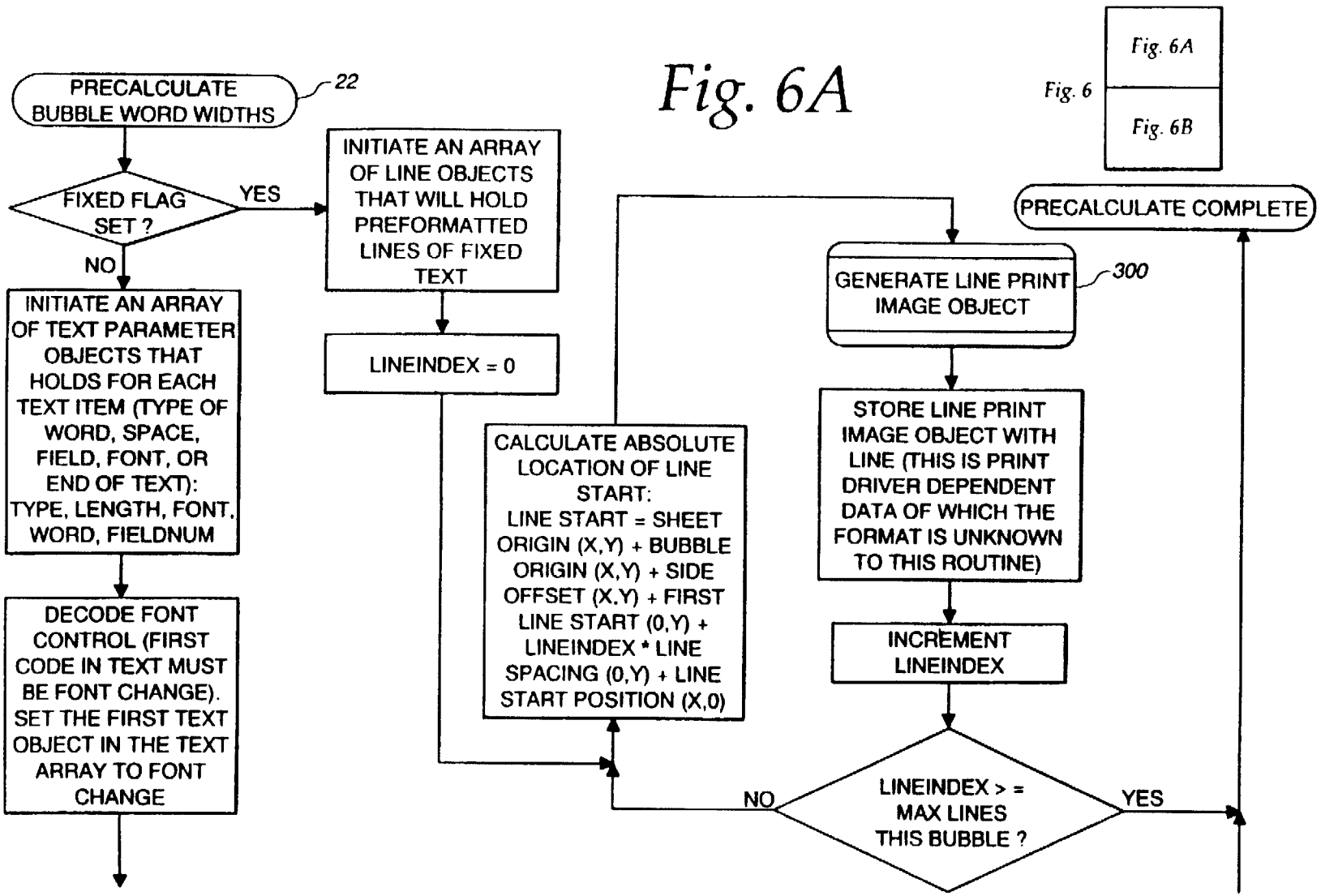
Fig. 6A
Fig. 6B
Fig. 6
PRECALCULATE COMPLETE
300
GENERATE LINE PRINT IMAGE OBJECT
STORE LINE PRINT IMAGE OBJECT WITH LINE (THIS IS PRINT DRIVER DEPENDENT DATA OF WHICH THE FORMAT IS UNKNOWN TO THIS ROUTINE)
INCREMENT LINEINDEX
LINEINDEX > = MAX LINES THIS BUBBLE ?
YES
NO
CALCULATE ABSOLUTE LOCATION OF LINE START: LINE START = SHEET ORIGIN (X,Y) + BUBBLE ORIGIN (X,Y) + SIDE OFFSET (X,Y) + FIRST LINE START (0,Y) + LINEINDEX * LINE SPACING (0,Y) + LINE START POSITION (X,0)
INITIATE AN ARRAY OF LINE OBJECTS THAT WILL HOLD PREFORMATTED LINES OF FIXED TEXT
LINEINDEX = 0
22
PRECALCULATE BUBBLE WORD WIDTHS
FIXED FLAG SET ?
YES
NO
INITIATE AN ARRAY OF TEXT PARAMETER OBJECTS THAT HOLDS FOR EACH TEXT ITEM (TYPE OF WORD, SPACE, FIELD, FONT, OR END OF TEXT): TYPE, LENGTH, FONT, WORD, FIELDNUM
DECODE FONT CONTROL (FIRST CODE IN TEXT MUST BE FONT CHANGE). SET THE FIRST TEXT OBJECT IN THE TEXT ARRAY TO FONT CHANGE

| Fig. 19A | Fig. 19B |
|---|---|

METHOD FOR MASS CUSTOMIZATION OF PRINTED MATERIALS

BACKGROUND OF THE INVENTION

1. Field of the Invention

The present invention relates generally to the creation, printing and manufacture of personalized printed materials, and more particularly, to a fully integrated method for mass producing personalized printed materials containing multiple displays of text within uniquely shaped regions, such as comic strips or comic books.

2. Description of the Related Art

Comics and comic books represent a combination of visual art work, character dialogue, and narration which have been enjoyed by both children and adult enthusiasts for years. The mass printing of conventional comics and comic books typically begins with the development of a storyline by an author followed by the creation of sketches of the various frames of comic containing characters and various background art adapted to depict the storyline. A familiar characteristic of comics is that the dialogue between characters as well as characters' individual thoughts are typically depicted as text located within specific regions of various shapes and sizes known as "balloons" or "bubbles". Background narration is also typically localized within defined regions such as a rectangular areas within the comic frame. All of this text, as well as the thought, dialogue and narration bubbles themselves are typically added by the artist according to the storyline as part of the process of creating the comic sketches. Another familiar characteristic of comics is that numerous different lettering sizes and styles are commonly employed in the text to add emphasis or to depict, for example the excited or surprised tone in a particular dialogue string.

As may be appreciated, the layout of the various text displays (i.e., dialogue text, thought text, or narration text) as well as the size and shape of the comic bubbles must be designed by the artist as part of the overall design of the comic frames so that space may be properly allocated between the characters, background art, and text material. Typically, the bubbles will have a shape similar to the outer contours of the text so that there is only limited space between the edge of the text within the bubbles and the borders of the bubbles. Thus, depending on whether the artist chooses to first design the bubble or the text for a given comic frame, the shape of a bubbles and the layout of the text displayed within the bubbles are often directly interrelated to each other.

For mass printing of a comic, the artist also typically adds trim marks at appropriate locations along the sides of the sketches to indicate the exact location at which the paper stock on which the comic is printed must eventually be trimmed to achieve the desired paper sheet size.

In order to facilitate mass printing of a sketched comic story on conventional printing equipment, the comic sketches are transformed onto film. The film is then used to make printing plates for use in a printing system, which prints the comic on paper stock. Such film may be generated from the sketches by means of an art board or other methods involving transforming sketches to digital media from which the film is generated. Further, the sketches themselves could be created in a digital environment. The print film generated by either method is then imaged onto the printing plates of the printing system. The comic may then be mass printed, trimmed, collated and bound into a book.

As can be appreciated from the method just described, a great deal of time and effort is expended developing the author's story for a particular comic book into the printing plates used to mass produce the comics embodying that story. Since the imaged printing plates for a given story fix the text as well as graphic information to be printed, each book printed from a given set of plates contains identical text and graphics.

However, for various applications it would be desirable to modify the text somewhat between the individual books being printed in a production run. For example, it is thought that a customized comic book which incorporates the reader as one of the characters or as the narrator of the storyline would have appeal as a novelty or collector's item to both children and adult comic book enthusiasts. Such a customized comic could be generated by integrating various personal information about the intended recipient of the book (i.e. name, age, friends' names, home town, etc.) into the dialogue between characters and/or into the narrative text. One method of generating such personalized comics would be to modify the comic sketches and generate new film and print plates for each individual customized book. However, it would not be economically feasible to use such a method to generate a large volume of personalized comic books in which several different types of personal data could appear. Alternatively, multiple copies of a comic could be printed with blank spaces left in the text displays to be later filled in with the custom information by the artist after printing. However, unless the lengths of the each custom text string added after printing coincided with the size of the blank space left in the printed text displays, the customized information would stand out from the remainder of the text and lower the overall aesthetic appeal of the comic. Such text misalignment would also make it more difficult to create the appearance that the author had written the finished comic story individually about the person who's personal information is integrated into the comic.

Methods for incorporating variable text information, such as personal information, into conventional story books and other printed novelties using computer-controlled printing devices are known in the art, but none are suitable to be adapted to the production of customized comics and comic books. U.S. Pat. Nos. 3,892,427 and 3,982,744 disclose methods for producing a personalized hard-covered book having variable and non-variable printed text which utilize a computer to print at least the variable portions of the text onto continuous form computer sheets. The methods disclosed in these patents do not address the difficult problems associated with merging variable text and non-variable text within one printing area, such as the comic bubbles and formatting the merged text in a manner that prevents the merged text from contacting the border of the bubbles and maintains the proper alignment of the text displayed within the bubbles. Nor do these patents teach how to control the excess space between the variable and fixed text and between the integrated text and the surrounding bubble borders. Further, these patents do not contemplate the overall coordination necessary from the initial sketching process to the final printing necessary to mass produce customized comics having alignment and spacing comparable to that of conventional comics.

U.S. Pat. No. 5,114,291 is also directed to the production of personalized storybooks. The method disclosed involves merging variable and non-variable text strings within a computer and printing the merged text in a storybook format on blank sheets. This method would also not allow one to print variable and non-variable text within multiple localized defined regions on a page, or to format the print in each region individually according to the shape of the region. The method disclosed in U.S. Pat. No. 5,213,461 for generating a personalized book has the further shortcoming of only allowing printing of text on one side of the printed sheets. Thus the method disclosed in that patent does not lend itself to comic book production, since comic text displays are typically contained on both sides of each sheet within the book.

Nor is the method described in U.S. Pat. No. 4,616,327, which involves the use of a pen plotter to generate personalized graphics and text, suitable for the high volume production of personalized comic books. Although required to allow the creation of personalized graphics as contemplated by that patent, a plotter based system involves a significant reduction in the printing speed as compared to other printing means.

SUMMARY OF THE INVENTION

An object of the present invention is to provide a fully integrated method of producing customized printed materials using high volume printing equipment.

Another object of the invention is to provide a method of forming customized comics in which variable text is fully integrated with fixed text in a manner which controls spacing between fixed and variable text.

Another object of the invention is to provide a method of producing custom comics which automatically formats fixed and variable text within defined text displays to control spacing between the text and the borders of the text displays.

Another object of the invention is to provide a method of generating printed novelties which allows personal or customized information to be associated with characters illustrated in a story.

Still another object of the present invention is to provide a method for printing variable and fixed text within variously shaped defined regions such as those characteristic of comics which assures proper horizontal and vertical alignment of the text within the defined regions.

Briefly, the present invention relates to a method for rapidly producing a high volume individually customized printed novelties containing printed text located within defined regions of text displays of various sizes and shapes. The method is particularly well-suited for the rapid mass production of customized or personalized comics or comic books. The method involves predetermining the location and maximum length of the variable text to be included in the text, providing paper stock containing art and the borders of text displays without text sized to accommodate the maximum length of the variable text strings, integrating and formatting the fixed and variable text so as to avoid excess spacing between the variable and surrounding text, and printing the integrated text within the blank text displays in a manner which avoids excess spacing between the text and the borders of text displays. The method utilizes conventional printing equipment to generate the printed paper stock and an electronic computer printer to add the customized text. The necessary data manipulation, formatting and printing is controlled by customization software of the invention. Finally, the present invention permits offset adjustment of all text on a page through use of a single reference.

BRIEF DESCRIPTION OF THE DRAWINGS

These and other objects of the present invention will be readily understood with reference to the following description and attached drawings, wherein.

DETAILED DESCRIPTION OF THE PREFERRED EMBODIMENT

The generation of the customized printed comics and other printed novelties according to the present invention generally involves developing a storyline suitable for customization, predetermining the category, maximum size and location of each string of variable text to be included in the story, designing text displays capable of accommodating the maximum size of the corresponding variable text strings, loading the fixed and variable text strings into the memory of a computer, sequentially integrating the variable and fixed text strings for each text display containing variable text, formatting the fixed and integrated text as desired for each text display, and locating and printing the formatted text within the borders of the text displays region.

Figure 1:
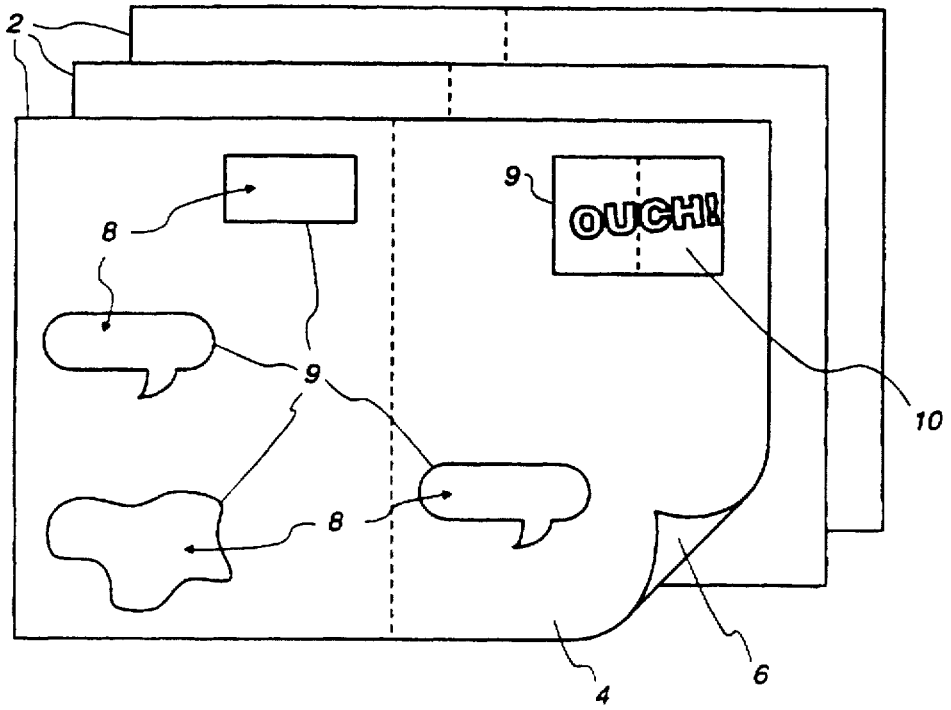
FIG. 1 is a block diagram representing pages ready for custom-formatting.

For purposes of describing the present invention, a text display is an area on a printed page defined by a border of any shape within which letters, words, and other symbols are printed. In the case of comic strips and comic books, text displays are also known as comic bubbles or balloons. FIG. 1 illustrates a typical example of a comic that may be customized according to the present invention containing text display 8 defined by borders. Text displays may contain fixed or non-variable text (i.e., text that does not change from comic to comic), variable text, or a combination of fixed and variable text. If a text display contains only fixed text, it is referred to as a fixed text display or bubble; otherwise, it is called a variable text display or bubble. The variable text within a variable bubble is identified by fields, there being the possibility of more than one variable field per bubble.

The method described herein for rapidly producing customized comics is accomplished using conventional printing equipment for providing unfinished comic stock suitable for customization, customization software which integrates and formats fixed and variable text for each text display of the comic, and a computer controlled electronic printer which prints the integrated text at precise locations to complete the customized comic. A computer program controls the various computational steps, data storage and manipulation, and printer control sequences necessary to carry out the invention.

As described above, an initial step in the creation of comic strips and comic books is the development of the storyline of the comic which generally includes determining the characters to appear in each frame of the comic, the appearance of each character in each frame, and the substance of any character dialogue, character thoughts or narrative comments to be included in each frame. It is to be understood that, depending on the author, the specification of a comic storyline may in some cases be manifest in a sketch or series of sketches while in others may be simply a written manuscript to be developed into a sketch at a later time.

In either case, for a given comic storyline desired to be customized, a determination must be made of the specific text within the storyline which one desires to vary in each printed copy of the comic. One application of the invention is to create a comic book in which personal information about the recipient of the comic book is included in the storyline. Thus, for example, the comic could incorporate the recipient as one of the characters in the story by having the recipient's name appear at each location in the story at which that character's name is mentioned. Other information, such as the recipient's age, sex, home town, and favorite activity, could be incorporated into the narrative comments describing that character. In some instances, certain variable text strings may appear more than once within a given storyline as, for example, if the customized character's name is mentioned many different times as the plot unfolds.

The location of each string of variable text within the storyline must also be determined. This requires identifying the specific text display in which each variable string is to appear as well as the location, relative to the fixed text, of the variable text within each display. In order to assure proper spacing alignment in the final printed comic, it is preferable that for each category of variable text string to be included in the storyline (i.e., name, age, sex, home town, activity . . . ), a maximum allowable length of that character string be determined so as to determine the necessary size of text displays containing that variable text string. Thus, for example, it might be determined that the maximum allowable length for the variable text string specifying the recipient's home town will be limited to 2.5 cm and the maximum allowable length for the recipient's name will be 3.0 cm.

Once this information regarding the maximum allowable length of each variable text string to be included in each text display has been determined, unfinished comic copy suitable for customization may be generated. The sketches for generating the unfinished copy should include all of the characters and other art work of the comic as well as the borders of the text displays. These sketches may be created by hand or by using computer aided drawing tools as are generally available. For various aesthetic reasons, it may be desirable to control the excess space between the borders of the text displays and the printed text of the customized comic, as well as space between variable and surrounding fixed text. In order to control such spaces, in generating the necessary comic sketches the characteristics of the different variable text strings should be taken into account when designing the borders of the text displays. This may be accomplished by penning in or otherwise including all of the fixed text in the sketches at the appropriate locations where it is to appear in the comic. This text may then be used to facilitate design of the text display regions and then, as explained more fully below, later removed prior to customization. Blank spaces are left at the proper location to accommodate for the variable text strings. The length of each blank space should correspond to the maximum allowable length of the variable string to be included at that location plus any desired spacing between the fixed text adjacent to the variable text string. After formatting the fixed text and blank variable text spaces of the text displays as desired, the borders of the text displays may be drawn taking into account the desired spacing between the edges of the text characters and the edges of the borders. This method of designing the size and shape of the text displays taking into account the characteristics of the fixed and variable text within the displays controls excess unprinted areas within the text displays while avoiding contact between the characters in the text displays and the text display borders. Preferably, the font size of the fixed text included in the comic sketches for purposes of designing the size and shape of the text displays should correspond closely to the font size of the fixed text printed in customization step. Most preferably, the text character fonts used to create the sketch are identical to those used in the printed text of the customized comic. This may be achieved by the utilization of digitized fonts in creating the comic sketches and the incorporation of the identical fonts into the customization software used in the present invention.

Although not required, the determination of the maximum allowable variable text string lengths in determining the size of the text displays may be facilitated by performing statistical analysis on a collection of personal data received from customers to determine, for each category of variable text, reasonable limits on the lengths of the personal or variable text strings. Personal data received from a customer which result in a variable text string longer than the maximum allowable length could be abbreviated or truncated to accommodate these limitations. In any event, maximum lengths of these variable text strings may be determined and accounted for in the design of the sketches for creating the unfinished comic stock.

Once the text displays have been designed, the fixed text in the displays is preferably removed, so that all of the fixed and variable text is added in the customization printing step. This helps to assure proper alignment and identical print density between adjacent fixed and variable text in the finished product. The one exception is when the text display itself contains a graphic such as graphic 10 in FIG. 1. In that case, all text in that display will be printed by the conventional graphics printer. However, where there are no graphics in a text display, the text will be printed electronically with a laser printer regardless of whether the text display has variable text or not. Of course, it is possible to electronically print text within displays containing graphics in accordance with the present invention; however, this makes it more difficult to match print densities within the displays of the finished comic, hence making the print of the finished comic less visually appealing.

The unfinished comic stock comprising the art work and empty text displays may be generated according to customary techniques from the comic sketches just described. As described above, this typically involves the generation of print film from the comic sketches which is then used to generate the print plates driven by a printing system to rapidly print the unfinished stock. This film may be generated by means of art boards, as is well known in the printing industry, or by more recent methods utilizing digital equipment. Alternatively, using computer-to-plate technology, the print plates could be directly generated from a digital environment which would eliminate using film.

Available printing methods for generating the unfinished stock generally are two types: (1) web printing systems which print onto continuous sheets fed from large paper rolls, and (2) sheet fed printers which print onto individual sheets of blank stock. Although not required, a sheet fed machine can be used in practicing the present invention, as such machines generally offer improved color quality and printing accuracy over web printers.

Using either type of printing system, several pages of comic may be printed on each side of the paper stock fed to the printing system. Thus, it may be necessary to cut the printed stock into the individual sheets that will be later fed into the laser printer for customization. In order to facilitate this, trim marks are added along the outer edges of the comic sketches to indicate the location at which the paper must be cut to generate single sheets of the comic of the desired size. These trim marks then appear on the print film and eventually on the unfinished stock to indicate the desired trim locations. The desired sheet size may depend on the desired sheet size of the final comic and/or the paper size limitations of the printing system used to add the customized text. In order to assure proper alignment of the text displays of the customized comic, it is important that these trim marks are accurately located and oriented and that the trim marks on both sides of the sheets are in alignment. Slight errors in the location or orientation of trim marks may propagate through the process of generating the print film and print heads into significant deviations from the desired paper size specifications. Ultimately, such deviations make it more difficult to control the customization printing system to properly locate and align the customized text within the text displays. For the same reason, it is also important that the cutting of printed unfinished copy follow the indicated trim marks accurately. Digital trimmers, which are standard in the industry, may be employed to facilitate accurate trimming.

Regardless of the equipment used, it is likely that some deviation in the size of the sheets of unfinished copy will be present. Additionally, slight deviations occurring between the alignment of the print film and the print plates may cause a slight skew of the printed comic on the trimmed and cut sheets. These deviations can later result in misalignment between the customized laser printed text and the borders of the text displays. As described in more detail below, the comic customization software of the present invention allows the operator of the customization printer to incorporate a simple offset command in the printer control sequence when a misalignment between the printed text and the borders of the text displays is detected. This offset command automatically shifts all of the text on a given side of a sheet by a specified amount to realign the text on that side within the corresponding text displays.

The unfinished printed stock generated as just described may be customized with the desired variable text by means of a controlled printer and the customization software of the present invention. A Xerox Model 4135 Laser Printing System is particularly well suited for the customization of comic books according to the present invention. This printing system prints both sides of the sheets of unfinished stock in one pass through the machine and allows the font control and print location accuracy necessary to produce high quality comic.

The actual variable text to be included in each copy of the customized comic is input into a computer such as a personal computer system and stored in a variable data file. For commercial production of large quantities of customized comic books, the personal information supplied by the purchaser of the book may be collected utilizing order forms or other suitable means. This data may be input into the computer manually by means of a computer keyboard or, alternatively, computer readable cards may be utilized and the data input performed using a card reader. In either case, the variable data file will contain, for each customer or other category of variable data, a record of the desired custom text strings associated with each category or field of variable text to be included in the story. The file may also contain other information about the customer such as the customer's mailing address which can then also be printed during the customization process. It may also be desired to store other information such as order numbers in the variable data file to facilitate production tracking. This variable data file may be conveniently maintained as an ASCII file using conventional database software, for example FOXPRO, Version 2.5.

This ASCII file exported from the database may be integrated by the customization software of the present invention, which builds and integrates all of the text in the variable and fixed text displays, formatting the text as required based on the contours of the text displays. The output of the customization software in accordance with the present invention results in a print image file which contains all of the text (both fixed and variable) to be printed in each text display on each side of each sheet of the unfinished stock as well as the printer control codes necessary to locate the text as desired and select the appropriate character fonts.

The print image file generated by the customization software must be loaded into the memory of the computer that controls the printer used for customization. If separate computer systems are used to run the customization software and to control the printer, the print image file may be written to disk and then loaded into the printer's computer system. The Xerox Model 4135 laser printer may be driven by a standard personal computer, for example, a personal computer based upon a type 80386 or 80486 Intel microprocessor, incorporating the Barr Print 370 Bus and Tag Interface Card, plugged into an available expansion slot and controlled by Barr Print 370 software. The Print 370 Bus and Tag Interface Card are conventionally available from Barr Systems, Inc., located in Gainesville, Fla. It should be noted that in the described embodiment, a printer driver configured for use with the Xerox 4135 printer is employed. (See e.g., FIGS. 13–17). However, use of alternate printers and alternate drivers is well within the level of skill in the art. Such print driver routines would be called identically from the other formatting routines. In addition, the driver routines can easily be configured to directly control a printer as well as to output to print image files.

FIG. 1 illustrates a plurality of sheets 2 each having two sides 4 and 6, either or both sides 4 and 6 having printed material thereon including graphics and text. As shown in FIG. 1, each sheet 2 in a saddle stitched comic book corresponds to four pages of the book—two pages on the front 4 and two pages on the opposite side 6. Thus, a comic book containing twenty numbered pages and a front and back cover would have a total of six sheets—five representing the pages of the book and one sheet being the cover. When practicing the present invention to customize multiple comic books in a single production run, prior to being customized, the sheets of unfinished paper stock can be pre-collated in the proper sequence to allow printing of all of the sheets for a single comic book to be printed at one time.

Figure 2:
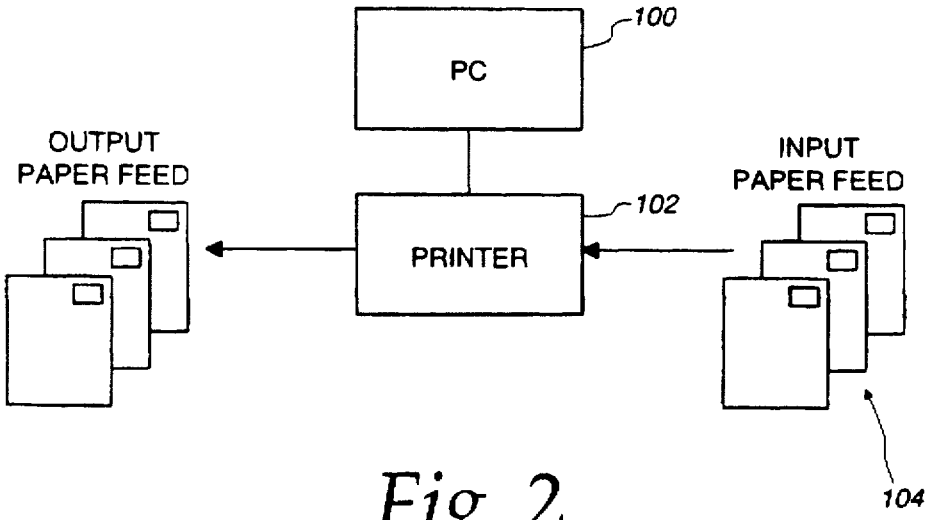
FIG. 2 is a block diagram of the formatting system in accordance with the present invention.

A block diagram of the system is shown in FIG. 2. The pre-collated paper stock 104 is fed into the printer 102, and using the personal computer 100 controlling the printer 102, the print image file is dumped to the printer and printing occurs. The integrated and formatted text is printed at the desired location within each text display to effect the customization of the comic pages. If a misalignment between all the text displays and borders of the text display regions is detected on a given sheet, as may occur if one side of the paper stock was not cut straight, a simple offset command may be employed by the operator which will cause the customization software to realign all of the text on that sheet by a specified amount to correct for the offset. Printing in a given bubble is done relative to a bubble reference point which, in turn, is referenced to a sheet reference point. In order to offset, only the sheet offset point need be moved. Thus, deviations in the trimming and cutting of the paper stock may be readily corrected with the customization software without having to respecify the locations of each individual text display. This feature greatly reduces the time and effort necessary to correct for paper stock that is not printed or cut exactly to desired specifications.

Once the text alignment has been checked and any necessary corrections applied, the customized comic stock may be trimmed if necessary and stitched and folded to finish the customized comic book. These steps can be done manually, or in a finishing apparatus, such as the Signature Booklet Maker supplied by Xerox.

It should also be noted that, although the present invention can be practiced to print the books one at a time, the sheets of customized stock could also be collated after customization. If uncollated stock is used, printing will occur in the order of each sheet in a given production run at a time (i.e., all of sheet one followed by all of sheet two . . . ). As explained more fully below, the customization software of the invention offers the flexibility to print the sheets of a given production run in this order by inputting simple commands that will cause the software to create print image files for either each sheet or each side of each sheet. The stock can then be collated after customization into the order required for final assembly of the comic book.

Similarly, although the Xerox 4135 Laser Printing System described above allows two-sided (duplex) printing, the customization software of the invention may also be conveniently used with a printer which does not support duplex printing. This customization software is understood more fully with reference to FIGS. 3–19.

The formatting will fit the text into the text displays 8, calculating the space occupied by variable and non-variable text and "wrapping" overrun words from one line to another within a text display 8. Thus, the variable text is completely integrated into the text within a text display 8. As discussed in more detail below, the length of the variable fields can be predetermined and abbreviated so as to prevent wrapping into too many lines of text to fit into a text display.

Figure 3:
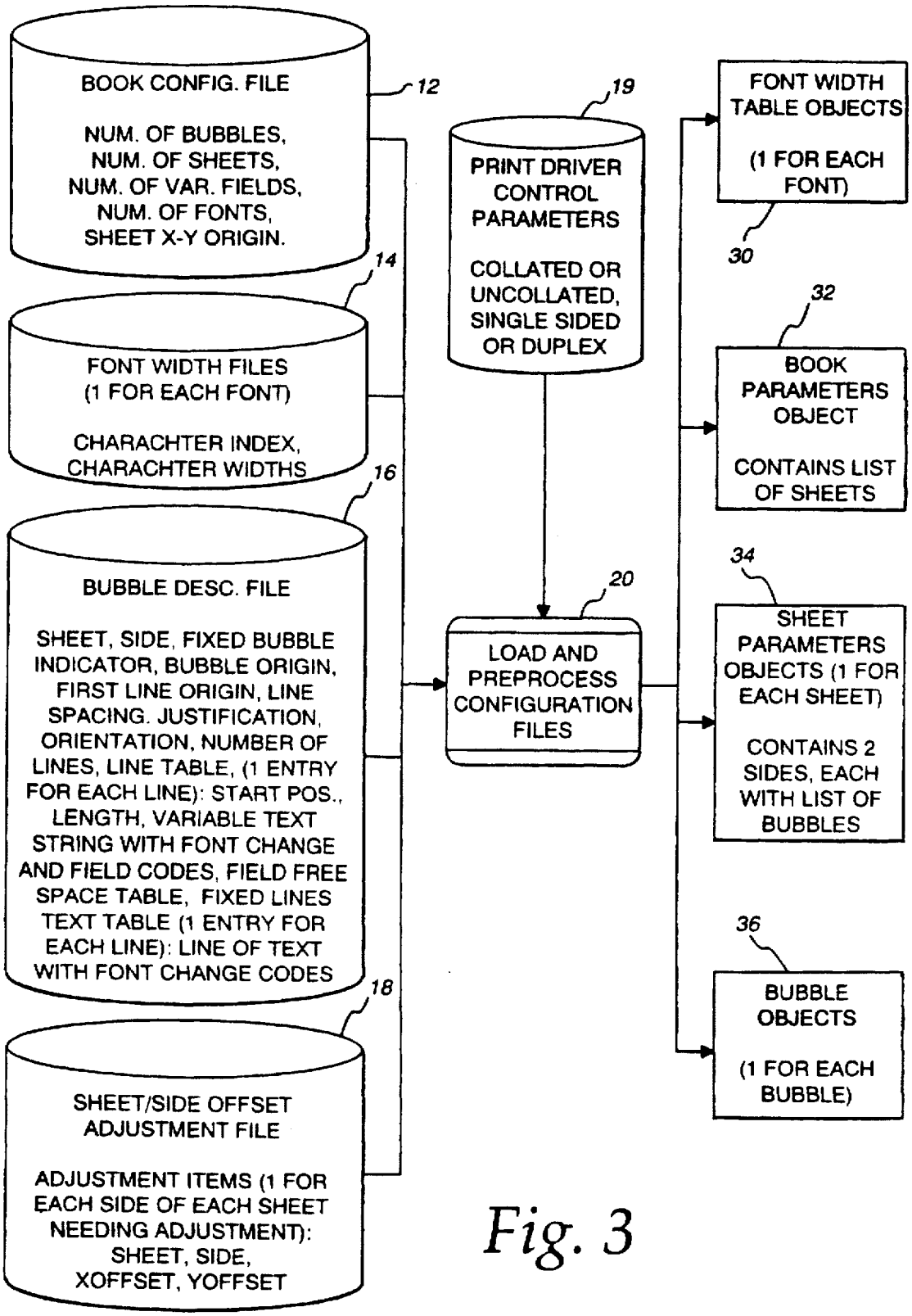
FIG. 3 is a flowchart showing the Load Configuration Data flow portion of the system.
Figure 4:
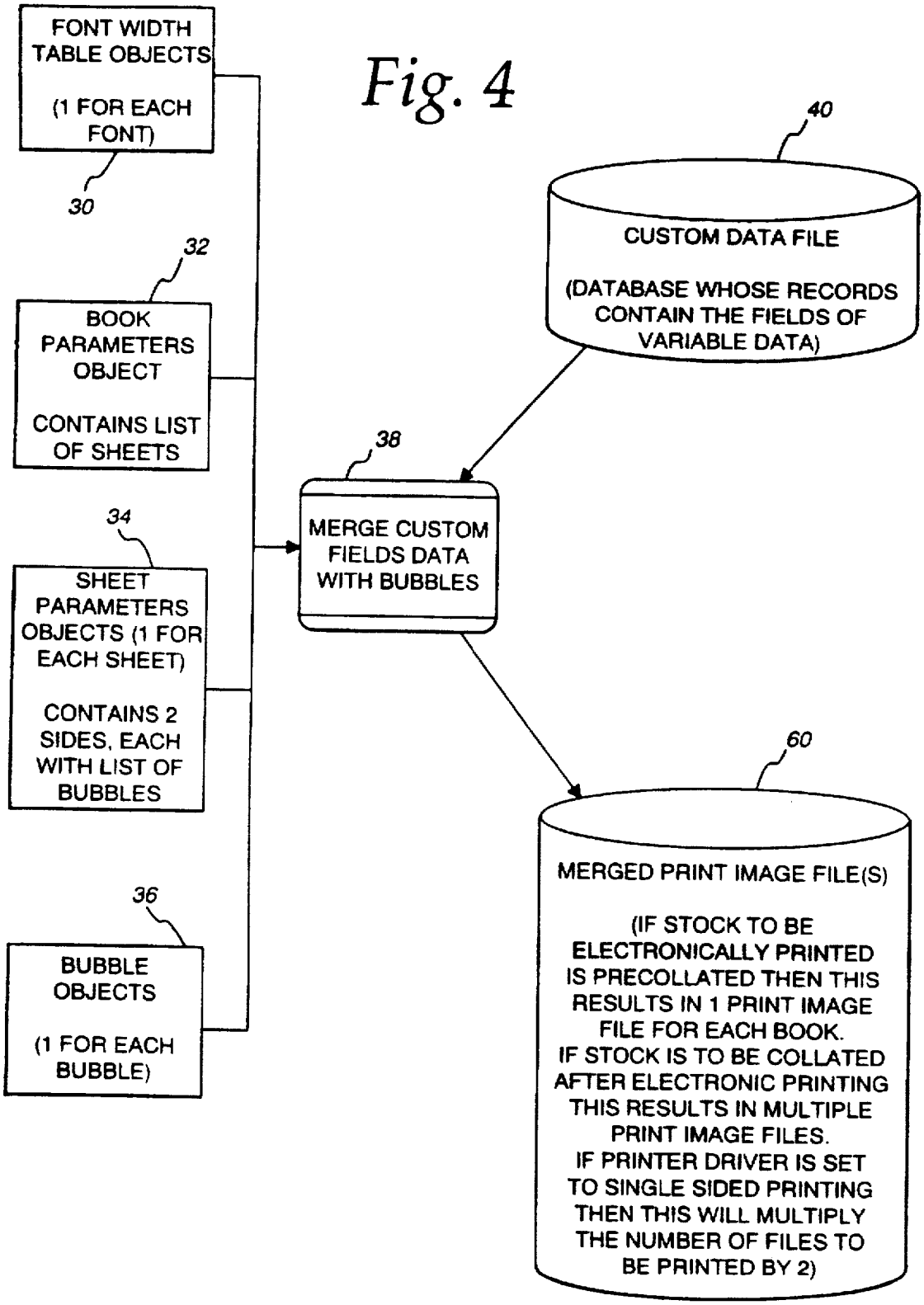
FIG. 4 is a flowchart showing the Merge Bubbles Data flow portion of the system.

The program for the text formatting process is illustrated in FIGS. 3 and 4. FIGS. 5–19 illustrate the program in more detail. The "C" or "C++" programming language may be used. It will be recognized, however, by those skilled in the art that other programming languages could be used without departing from the scope of the present invention. The result of the formatting is a print image file or files 60 that contain all the text to be printed on each side 4, 6 of each sheet 2, and the associated printer control codes to locate the text and select the appropriate fonts.

Figure 5:
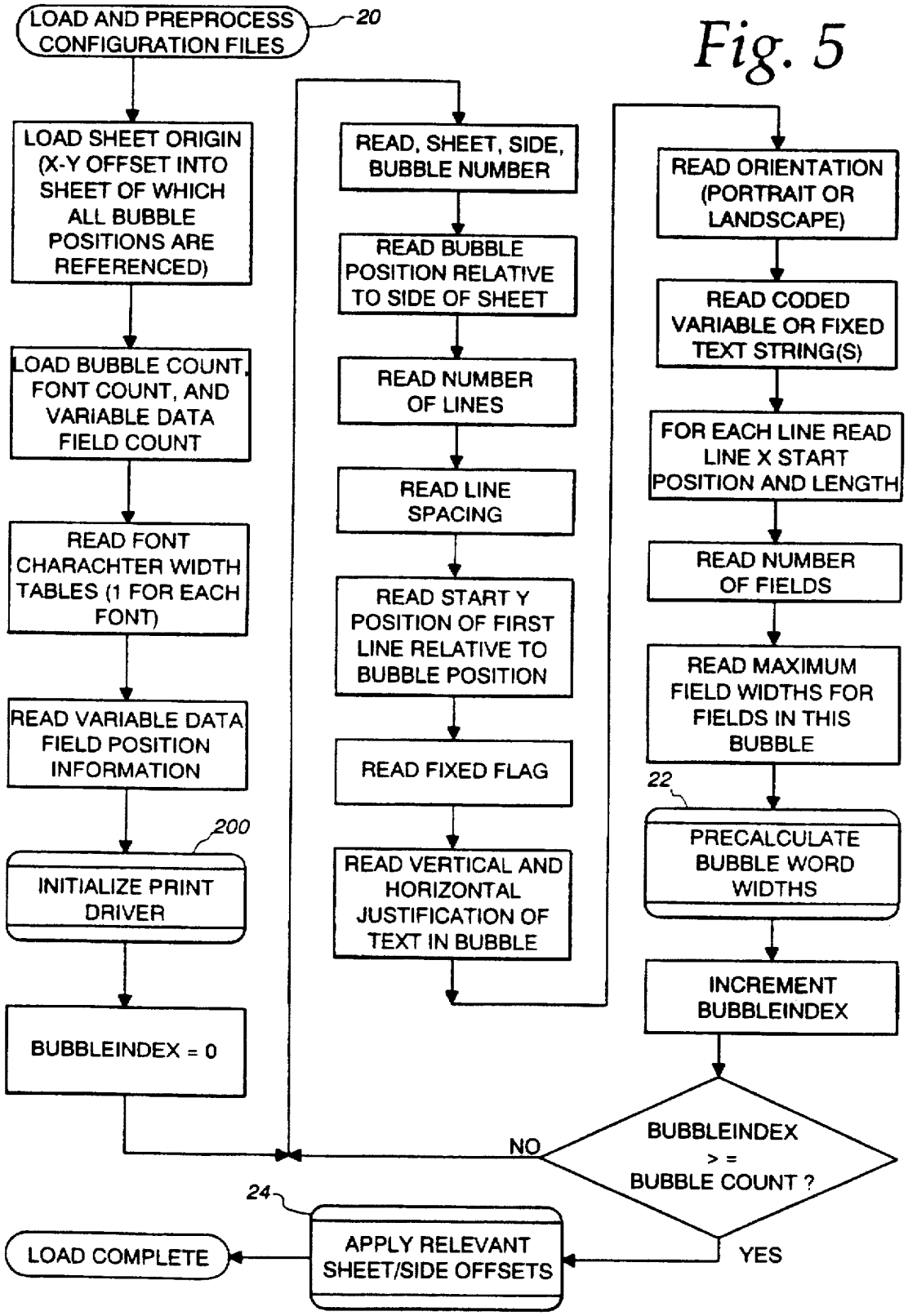
FIG. 5 is a flowchart showing the Load and Pre-process Configuration flow portion of the system.

Turning now to FIGS. 3–5, the initial step 20 is to input a variety of configuration files for each comic book. These configuration files contain all the data relating to formatting all the text displays 8 in each book. In particular, a book configuration file 12, a font width file 14 (one file for each font), a text display description file 16 (or "bubble" description file) and a sheet/side offset adjustment file 18 are loaded into the computer. Also a print driver control parameters file 19 is loaded and a custom data file 40 containing records of each customer's personalized information, such as name and date of birth, is input.

The book configuration file 12 contains information related to the number of text displays 8, the number of sheets 2, the number of variable fields, the number of fonts and the X-Y origin for each sheet, to which the origins of all text displays 8 are referenced.

The font width file 14 for each font contains information on all character widths. This information is used to determine how much space should be allocated for centering and whether "wrapping" of the text from a given line to another within a text display 8 is necessary. The text display description file 16 contains information for each text display 8. In particular, it contains data related to which sheet 2 and which side 4, 6 of the sheet each text display 8 is on, whether the text display 8 is a fixed or variable bubble, the origin of the text display 8 on a sheet (referenced to the sheet origin), the origin of the first line in the text display 8 (relative to the text display origin), and data regarding the line spacing, justification (both horizontal and vertical), and numbers of lines for each text display. In addition, for each line within the text display, the text display description file 16 provides a starting position relative to the X coordinate of the text display origins and information regarding the length of text within the bubble. Finally, the text display description file 16 contains data with font change codes for the variable text strings and, for each fixed text line, a line of text with the font change codes.

The sheet/side offset adjustment file 18 contains information that allows for applying fine-tuned adjustments for changing the location of all the text displays on a side of a particular sheet. Thus, the sheet side offset adjustment files 18 contain data related to the sheet, the sides and the X and Y offsets.

The print driver control parameters file 19 tells the system whether the sheets 2 have been collated or uncollated, and whether the printer can accommodate two-sided or duplex printing, or whether it can only print on one side of a sheet at a time. As used herein, "collated" or "pre-collated" refers to printing all the sheets of an individual comic book at a time, in order. "Uncollated" refers to printing each sheet of a given production run of comic books at a time, and then collating the sheets into the individual comic books later.

The Load and Pre-process Configuration routine 20 reads the configuration files 12, 14, 16, 18 and 19, and generates objects 30, 32, 34 and 36. The loading process is completed upon loading into memory a font width table object 30 for each font, a book parameter object 32 which contains a list of sheets, a sheet parameters object 34 for each sheet which contains two sides each with a list of the text displays, and a text display or bubble object 36 for each text display 8. The text display object 36 contains the text display configuration and location information and fixed text with embedded fields and font change codes.

A merge custom fields routine 38 uses the objects 30, 32, 34 and 36 in conjunction with the custom data file 40 of the variable data contained in the database discussed above to output print image file or files 60. The merge custom fields data routine 38 outputs the print image file or files 60 which contain information for each line of text in each variable and fixed text display. Each record in the file corresponds to each line in each text display and contains embedded printer control information for the specific printer being used.

The Load and Pre-process Configuration routine 20 is illustrated in more detail in FIG. 5. As discussed above, the Load and Pre-process Configuration routine 20 loads the configuration files 12, 14, 16 and 18. It also reads and initializes (using routine 200), the printer driver control parameters single or duplex, collated or uncollated (See FIG. 13).

Figure 15:
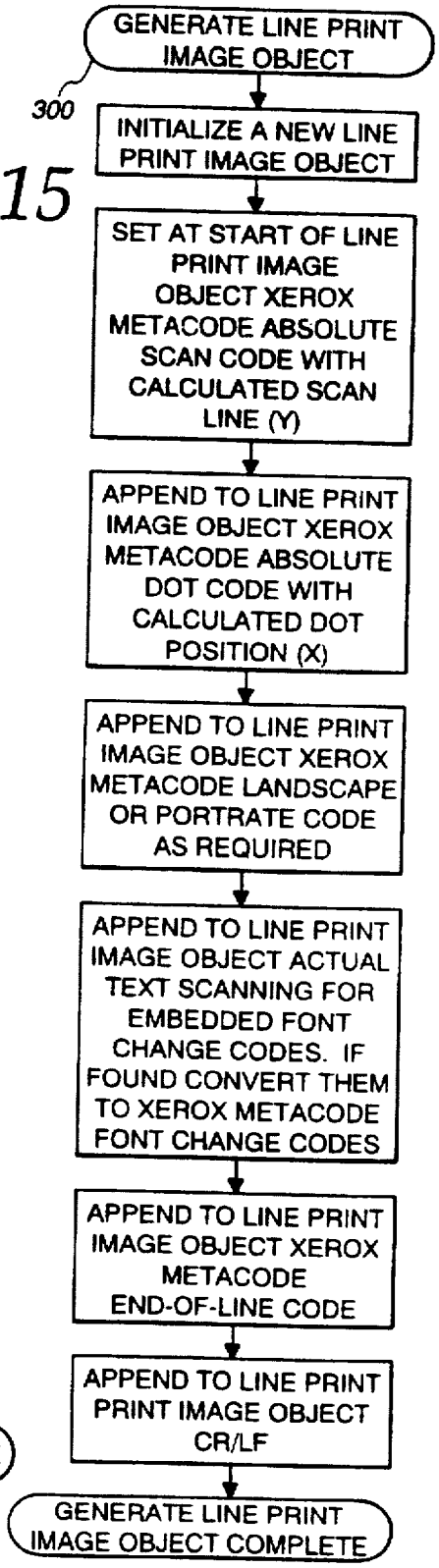
FIG. 15 is a flowchart of the Generate Line Print Image Object portion of the system.

In addition, the Load and Pre-process Configuration routine 20 pre-calculates the text display word widths using the Pre-calculate Bubble Word Width routine 22. The Pre-calculate Bubble Word Width routine 22 is illustrated in more detail in FIG. 6. For each bubble, it is determined whether there is any variable text. If there is no variable text an array of line objects is created using the Generate Line Image Object Routine 300 (FIG. 15). For each text display 8 all of the text and position information is read in and stored. For each line, each character is loaded into the current line. If a font change occurs, the printer font change code will be inserted in the line. An absolute location of the start of the line is calculated based upon the sheet X-Y origin, the bubble origins, the first line start, the line spacing and the line start position.

If there is variable text within a bubble 8, the text is broken up into words and spaces so that the points for "wrapping" text, for fitting the variable fields into the completely integrated bubble, can be determined. The actual "wrapping" will occur when the variable field is merged and its width actually calculated. An array of text parameter objects is created which holds for each text item an object with the following information: type, length, font, actual text, and field number. There are five types of text objects: Words, spaces, variable fields, font changes, and ends of line. Not all types use all information (e.g., font changes have no text or field information). For words, the text object contains the actual text of the word itself. For the variable fields, the text object holds a numerical identifier. In addition, the initial font control is decoded. This should be a font change identifier. The program then sets the array to "font change."

Next, for each word a length is calculated in the current font and the length, type and word itself are indicated. For a font command, the current font is set to a new value and the printer font change code is initialized. For a variable field, the item's type, font, and field number are set. For a space, the array type is set to "space." For end of line, the object's type is set to "end of text."

Once this control information has been loaded for each text display, the Sheet/Side Offsets routine 24 allows for adjustments to the location of all text displays 8 on a side of a particular sheet, if necessary. As discussed above, a sheet/side offset adjustment may be required if the cutting, trimming or printing of stock is not precise. The Sheet/Side Offset routine 24 is illustrated in more detail in FIG. 7. If an offset record is available, it will be read. Data in the offset record include the sheet, the side and the X and Y offsets. Should it be necessary, the X and Y offsets for each side will be recalculated.

Figure 6B:
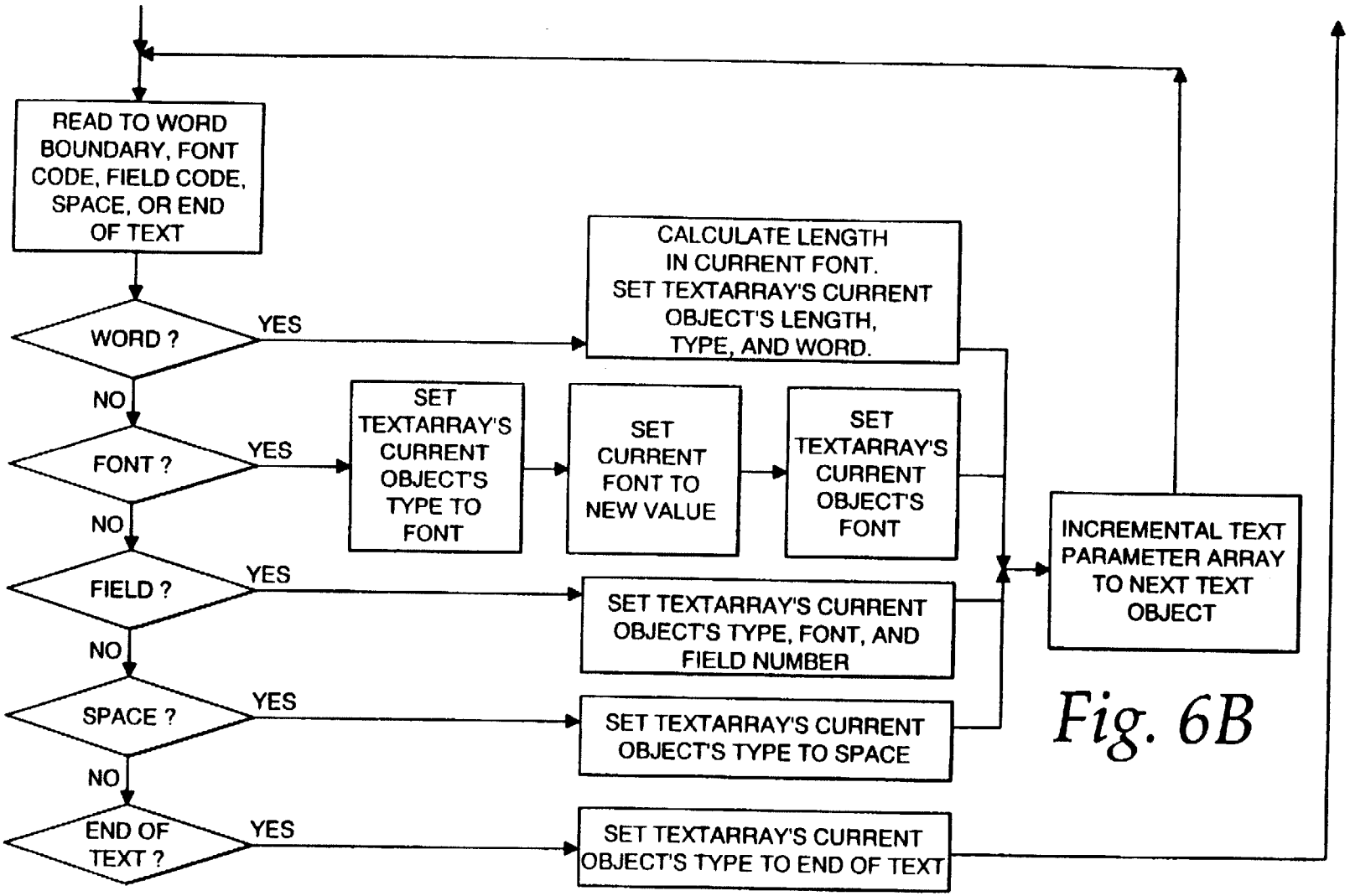
FIG. 6 is a flowchart showing the Precalculate Bubble Word Widths portion of the system.
Figure 7:
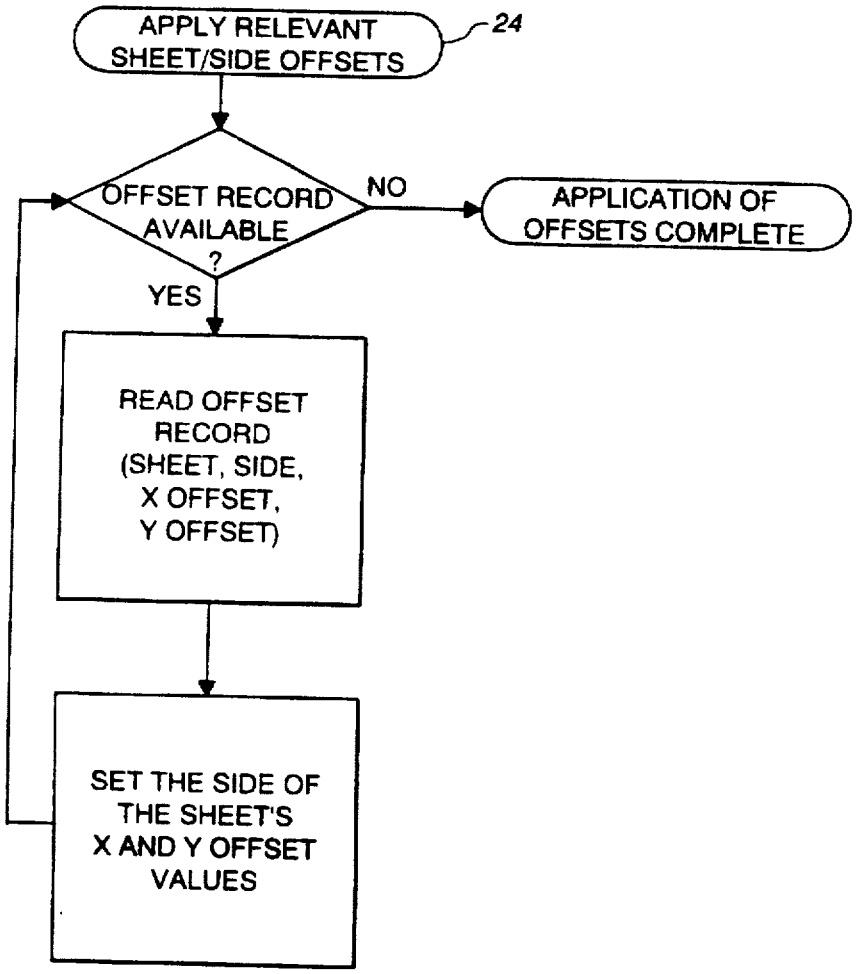
FIG. 7 is a flowchart showing the Apply Relevant Sheet/Side Offsets portion of the system.

Once the process described in FIGS. 5–7 has been completed, the load has been completed, the object files have been generated and it remains only to merge the custom fields data 60 with the variable text information on a sheet-by-sheet side-by-side basis.

Figure 8:
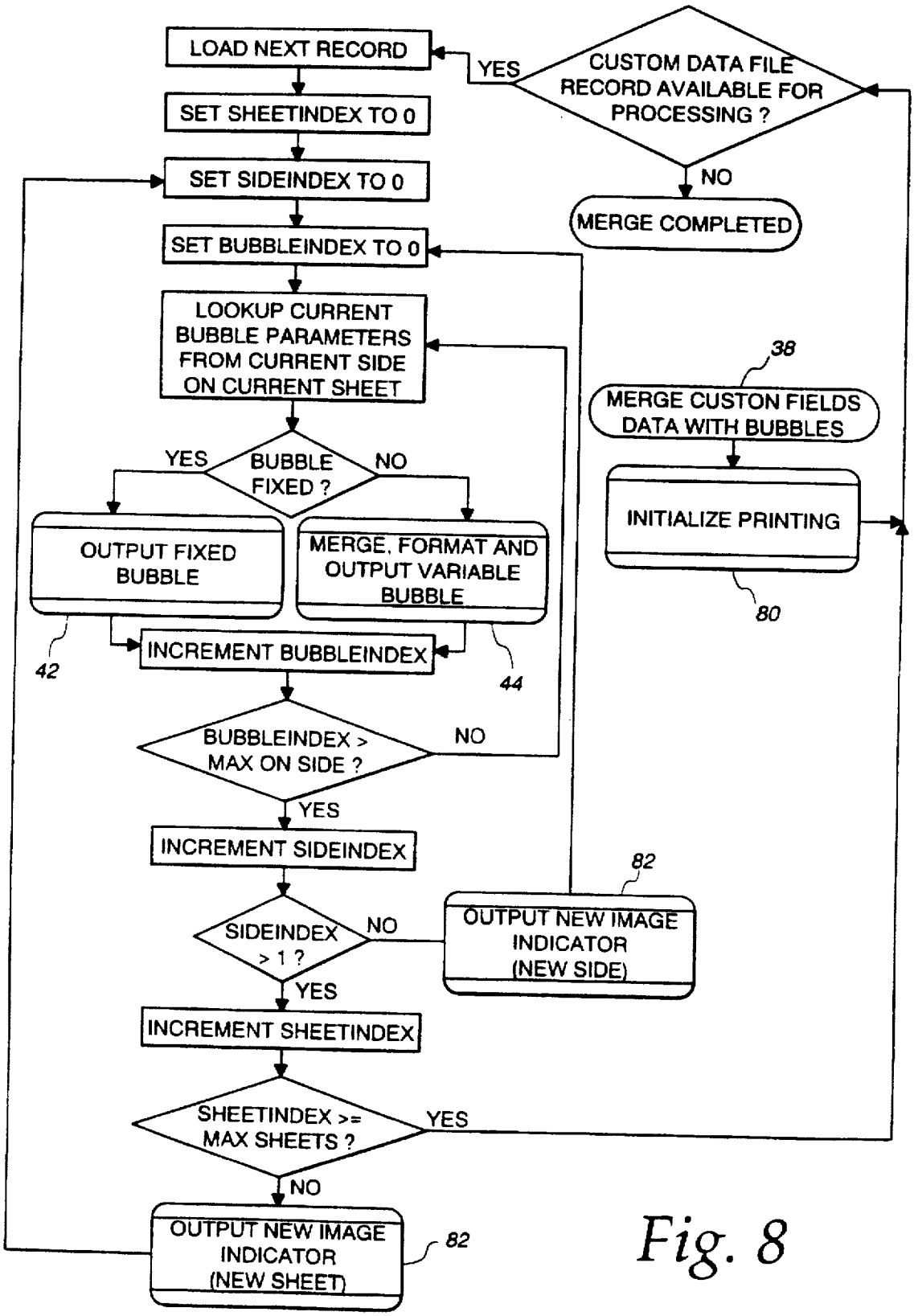
FIG. 8 is a flowchart of the Merge Custom Fields Data with Bubbles portion of the system.

The merge custom fields data routine 38 is illustrated in FIG. 8. This routine will read the custom data file record for each book and merge that information with the fixed information. The first step here is to call the Initialize Printing routine 80, illustrated in FIG. 14. This routine reads the print driver control parameters and opens output image files based on whether there is single-sided or duplex printing, and whether the stock is collated. In particular, if the stock is collated and the printer is configured for duplex printing, then there will be only one image file. If there is single sided printing, but the stock is collated, there will be two image files—one image file for each side. If the stock is uncollated, but the printer is duplex, there will be an image file for each sheet. If the stock is both uncollated and printing is single-sided, there will be an image file for each side of each sheet.

Figure 9:
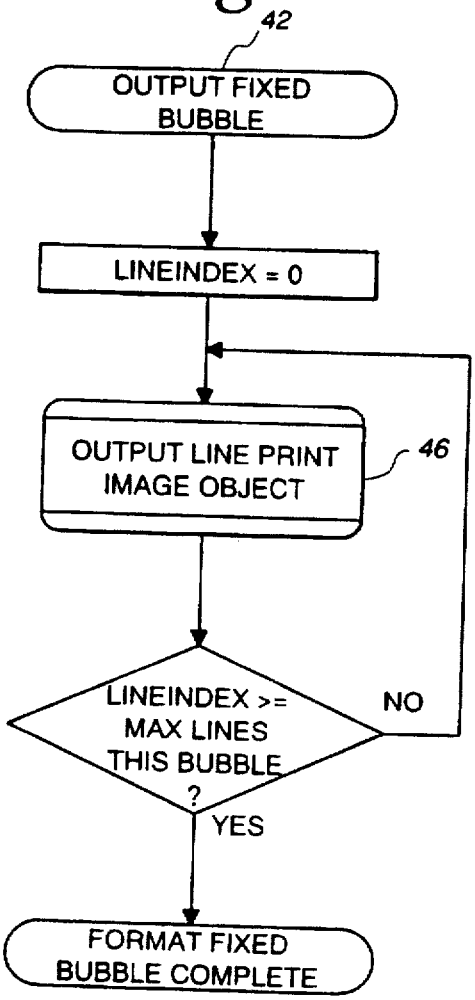
FIG. 9 shows the Output Fixed Bubble portions of the system.
Figure 12:
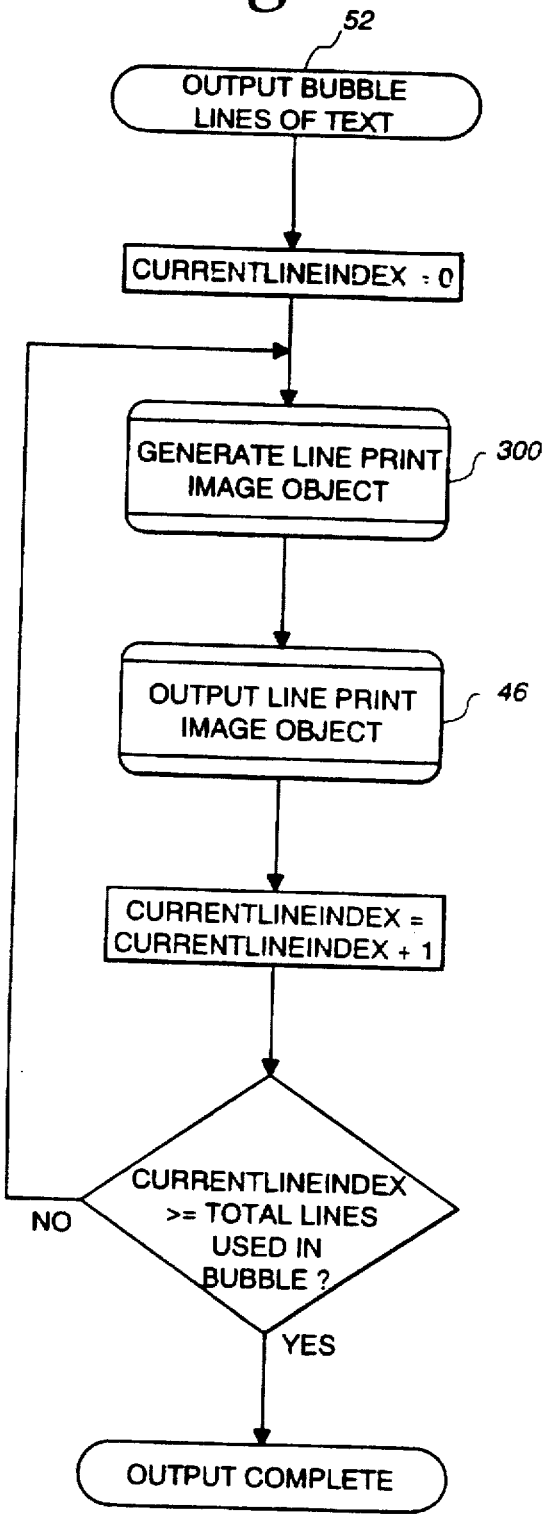
FIG. 12 is a flowchart of the Output Bubble Lines of Text portion of the system.

Each text display 8 will have its lines formatted and output in print image format, on a side-by-side, sheet-by-sheet basis. If a custom data file record 60 is available for processing, the record will be loaded and for each sheet 2, side 4, 6 and text display 8 it will be determined whether each text display contains fixed or variable data. If it contains fixed data, the Output Fixed Bubble routine 42 will be called. The Output Fixed Bubble routine 42 is illustrated in FIG. 9. The fixed text displays 8 have already been preformatted during the read of the configuration data described above and need only to be output. The Output Line Print Image writes the line print image object to the current file. The Output Line Print Image routine 46 causes the pre-formatted line of text with the needed font change control codes, and other controls to be output.

If a text display 8 contains variable data, then the Merge, Format and Output Variable Bubble routine 44 will be called and a merge will be completed. For each variable text display 8, the current custom fields used in that text display have their widths calculated based upon their font. Then each line is built.

Figure 10A:
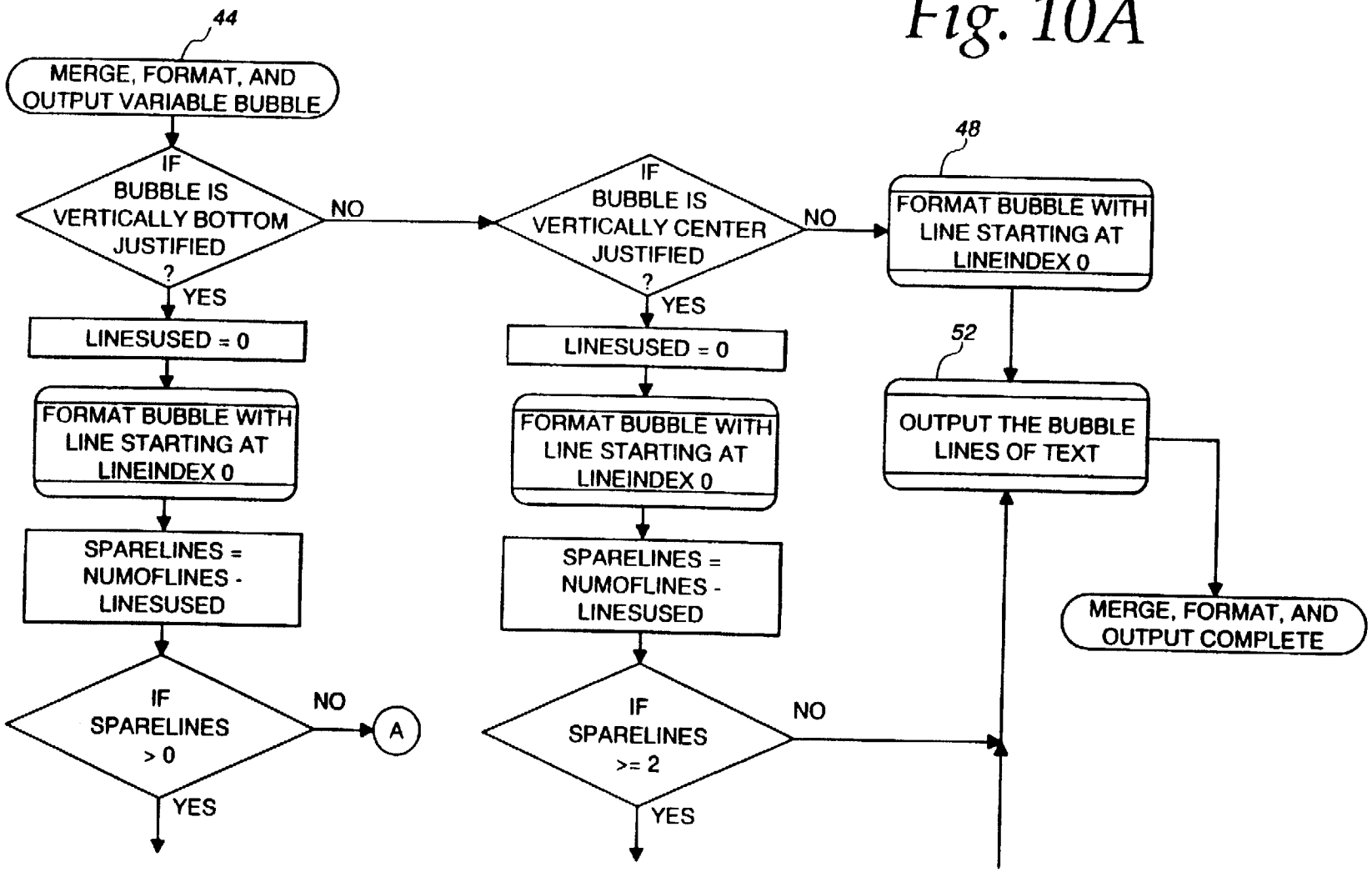
FIG. 10 is a flowchart of the Merge, Format and Output Variable Bubble portion of the system.
Figure 10B:
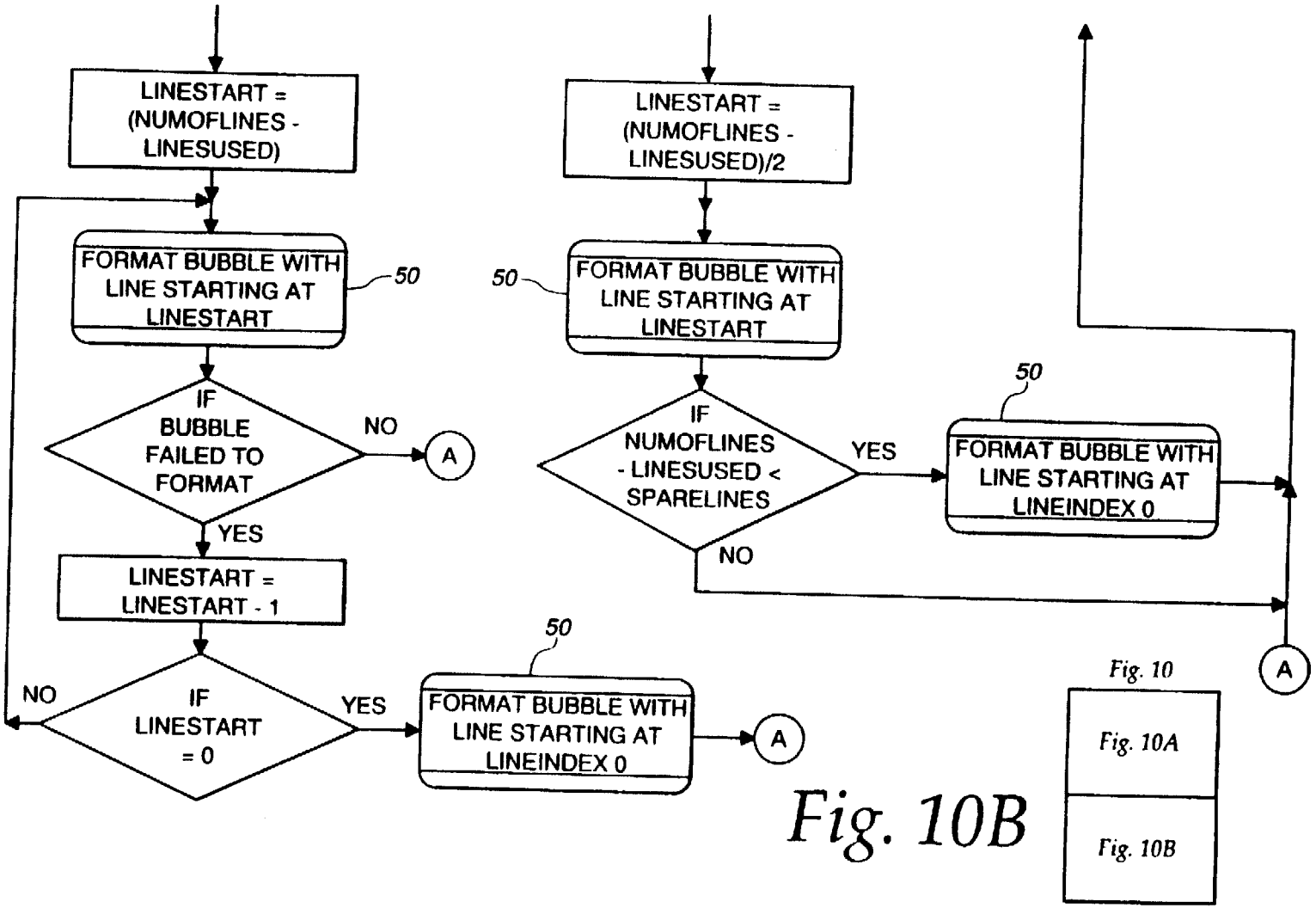
Figure 11A:
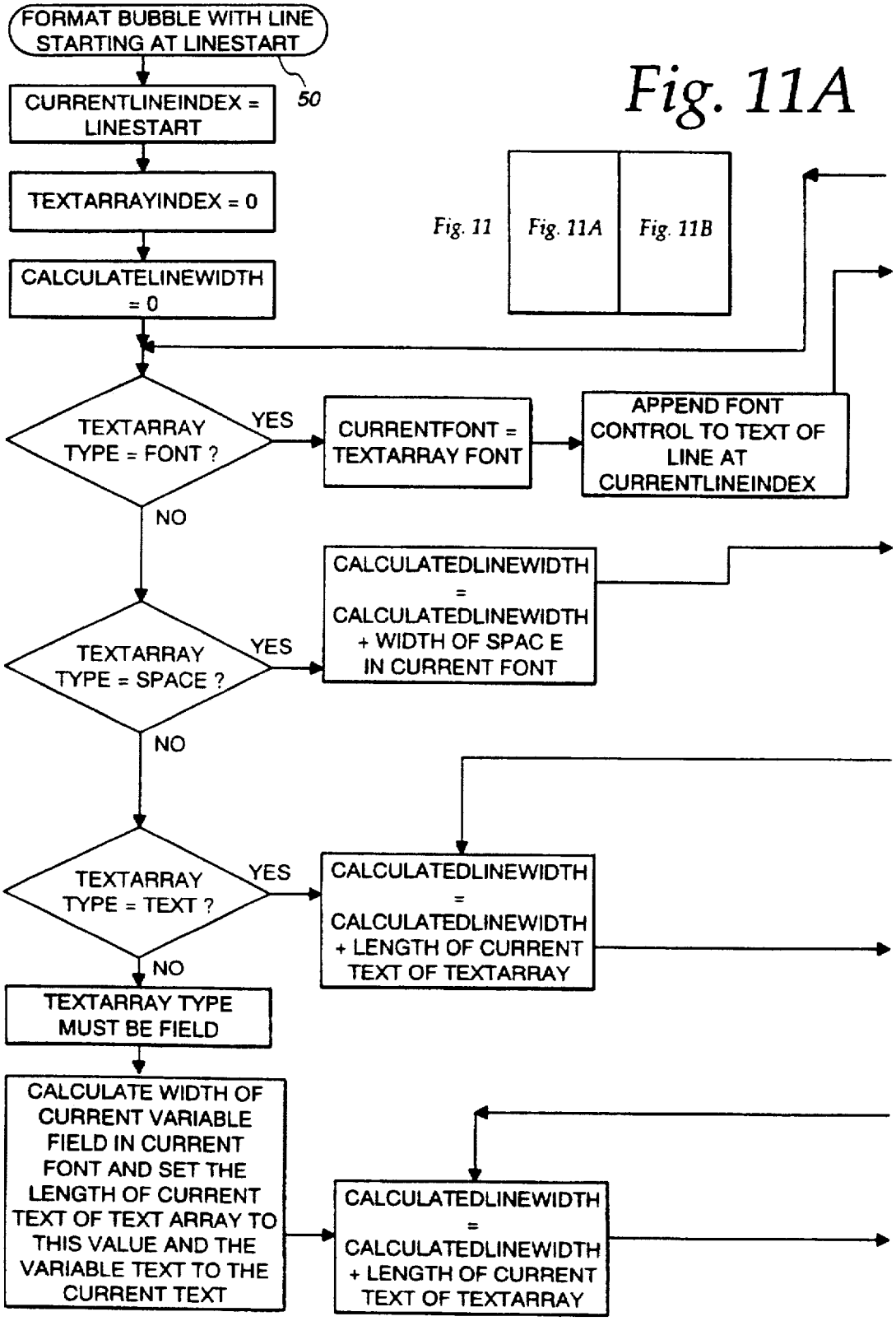
FIG. 11 is a flowchart of the Format Bubble Starting at Line Start portion of the system.
Figure 11B:
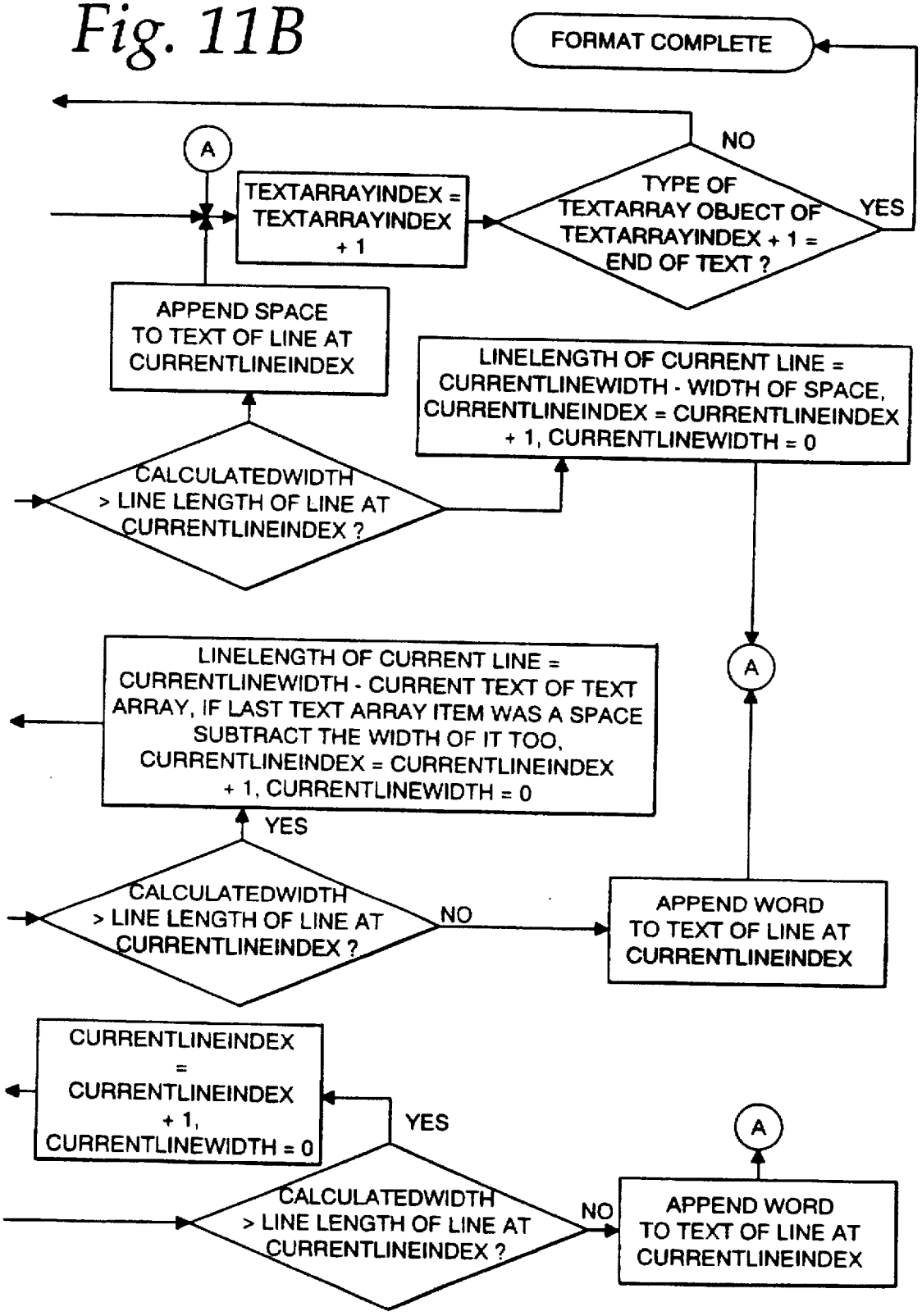
Figure 13:
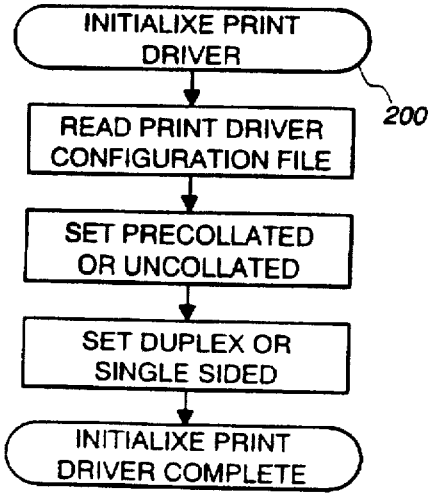
FIG. 13 is a flowchart of the Initialize Print Driver portion of the system.
Figure 14:
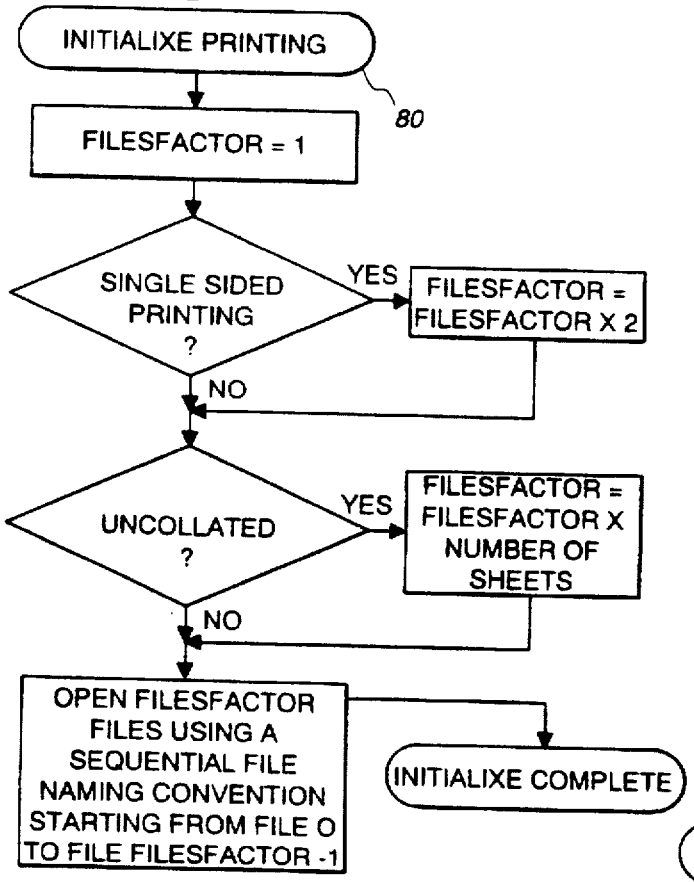
FIG. 14 is a flowchart of the Initialize Printing portion of the system.

The Merge and Format Variable Bubble routine 44 is illustrated in greater detail in FIGS. 10 and 11 (The Format Bubble with Line Starting at Line Start routine 50 is the same as the Format Bubble with Line Starting at Line Index 0 routine, but with a different initializing variable).

The routine 44 first determines whether there is any vertical justification because the line formatting will depend on where in a text display 8 it is located. If there is no vertical justification, then each item in the text display 8 is accessed from left to right, with the item's length added to a cumulative length that was initialized to 0 at the beginning of the line. The lengths of spaces, fixed text and the actual variable field lengths all contribute to the line's length. The cumulative line length is compared to a known current line length. If the cumulative length is greater than the known current line length, then the current line is set to the next line. The cumulative line length, with the overrun word's length subtracted, is then saved. If the word prior to the overrun word is a space, the length of the space is also deducted. The cumulative length is then reset to 0 and the word's length is added to the new current line's cumulative length. This continues until all the words of variable text have been processed.

If the text display 8 is vertically bottom justified (i.e., there are no blank lines of text between the last line and the bottom of the bubble), the bubble is initially formatted as described above. If there is a greater number of lines available in the bubble then lines actually used, then the bubble is reformatted with a new line start which is equal to the number of spare lines. Because of varying line lengths, it is possible that this new formatting will fail. In this case, the text display starting line is moved up one line and formatting as described above is attempted again. This will continue until the formatting succeeds or the new start line is the first line of the bubble. The first line of the bubble will always format. If the bubble is vertically center justified (i.e., the text in the bubble is centered vertically), the same process occurs, except that the starting line is half the available extra lines. The number of lines is always rounded down, so that one extra line would result in no reformatting.

After vertical justification, each line of text is justified left, right or centered. If left justified, the line would start at its starting X position in the bubble. If right justified, any extra space will be added to the X starting position for that line. Center justification will cut the extra space in half and add that to the X starting position.

Once the text displays 8 have been formatted, the Output Bubble Lines of Text routine 52 (FIG. 12) the Generate Line Print Image Object routine 300 (FIG. 15) and Output Line Print Image Object routine 46 (FIG. 16) are called which generate as output the principal text lines.

Figure 17:
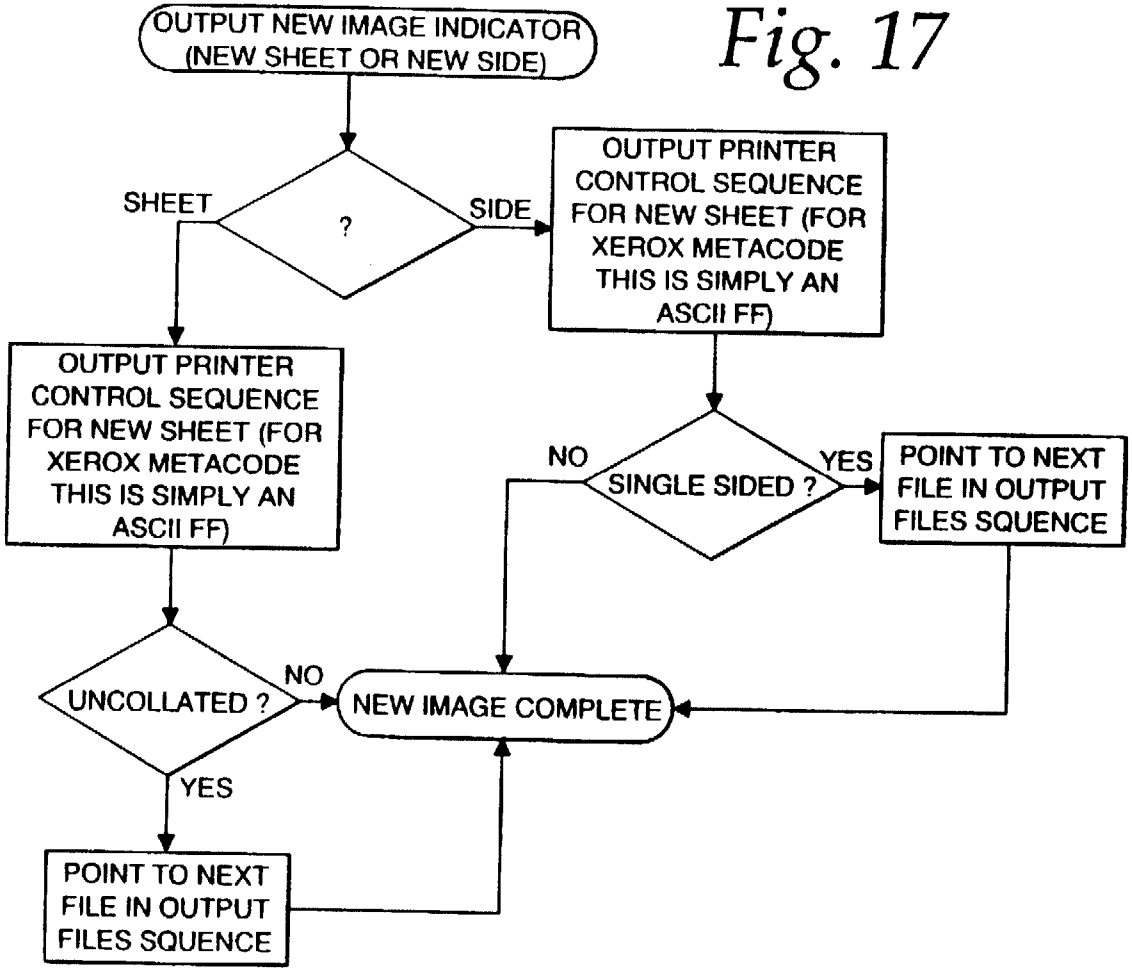
FIG. 17 is a flow chart of the Output New Image Indicator Portion of the system.
Figure 16:
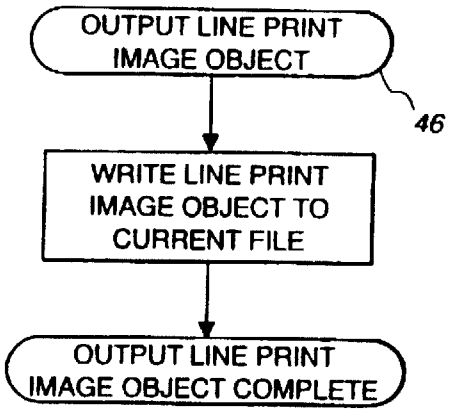
FIG. 16 is a flowchart of the Output Line Print Image Object portion of the system.

If the formatted text display 8 is the last on a side or on a sheet, the Output New Image Indicator routine 82, illustrated in FIG. 17 is called. If a new side is indicated, a printer control sequence, such as a form feed, is output. If the sheet is duplex, the formatting of the side is completed and the next side will be formatted. If single-sided, then the next file in the output sequence is indicated before going on to the next side. If a new sheet is indicated, then again a printer control sequence, such as form feed, is indicated. If the book is collated, then the formatting is completed. If uncollated, then the next file in the sequence is indicated before going on to the next sheet. This continues until formatting of all the bubbles in a comic book and a production run have been formatted.

As discussed above, there are instances in which it is desirable to know the maximum field length. For example, the artist creates a bubble of sufficient size to accommodate most variable data. If the width of a variable field is greater than the artist anticipates, however, the formatting of the bubble could fail. Accordingly, a routine is provided which determines whether there are any fields of excess length and generates a report to allow the excess length fields to be accommodated, for example, by abbreviations.

Figure 18:
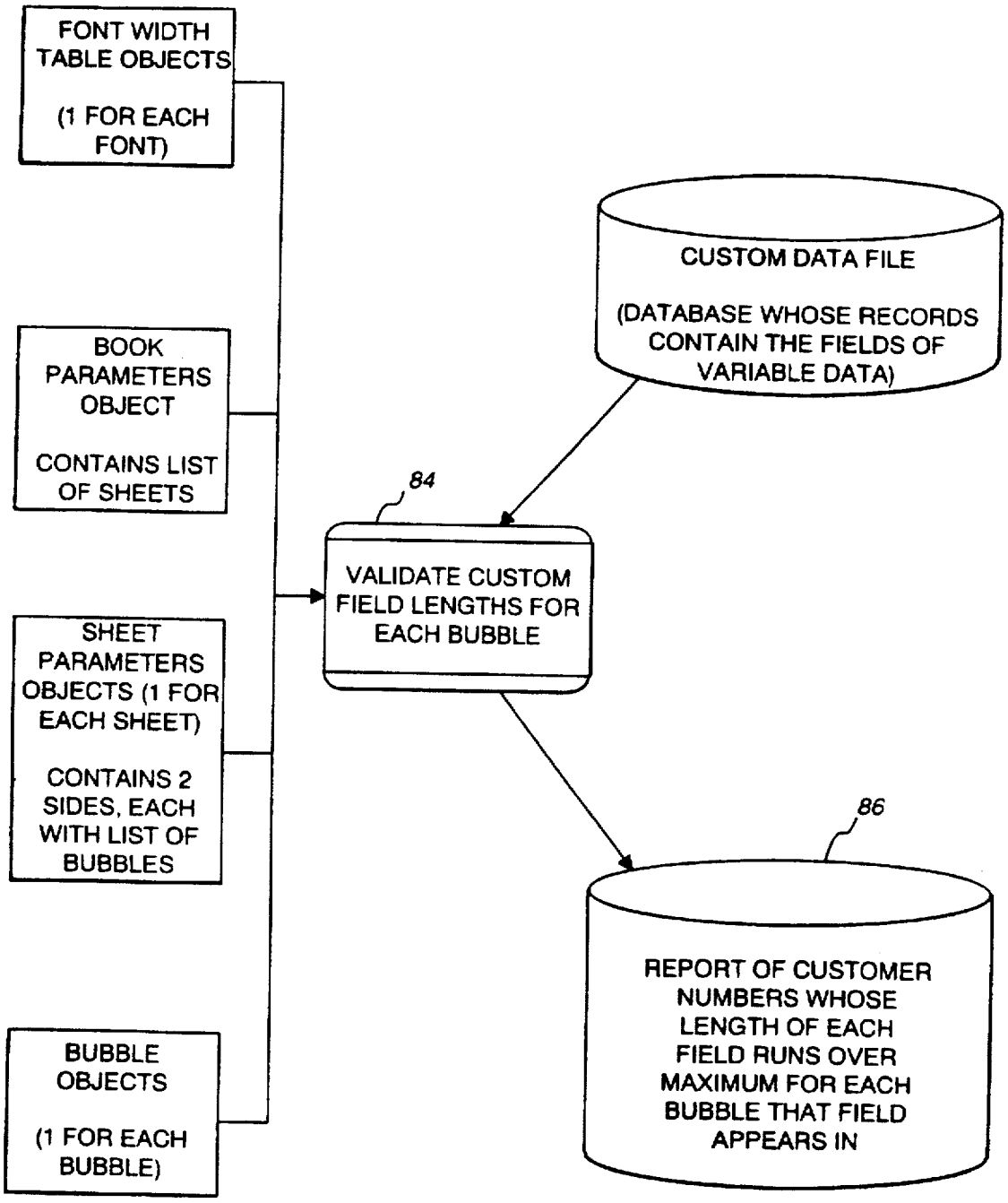
FIG. 18 is a flowchart of the Field Width Validation Data Flow portion of the system.
Figures 19, 19A:
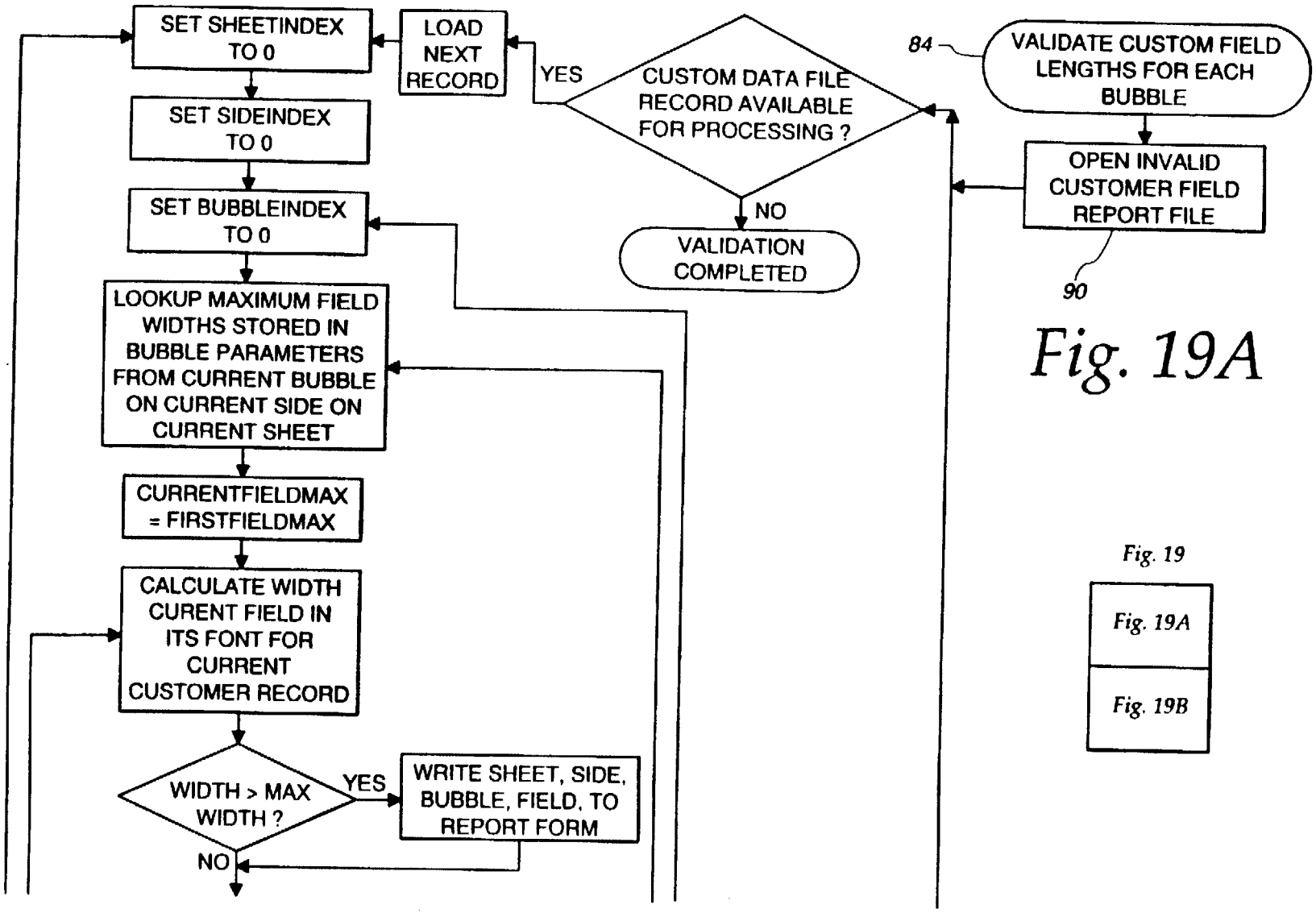
FIG. 19 is a flowchart of the Validate Custom Field Lengths for Each Bubble portion of the system.
Figure 19B:
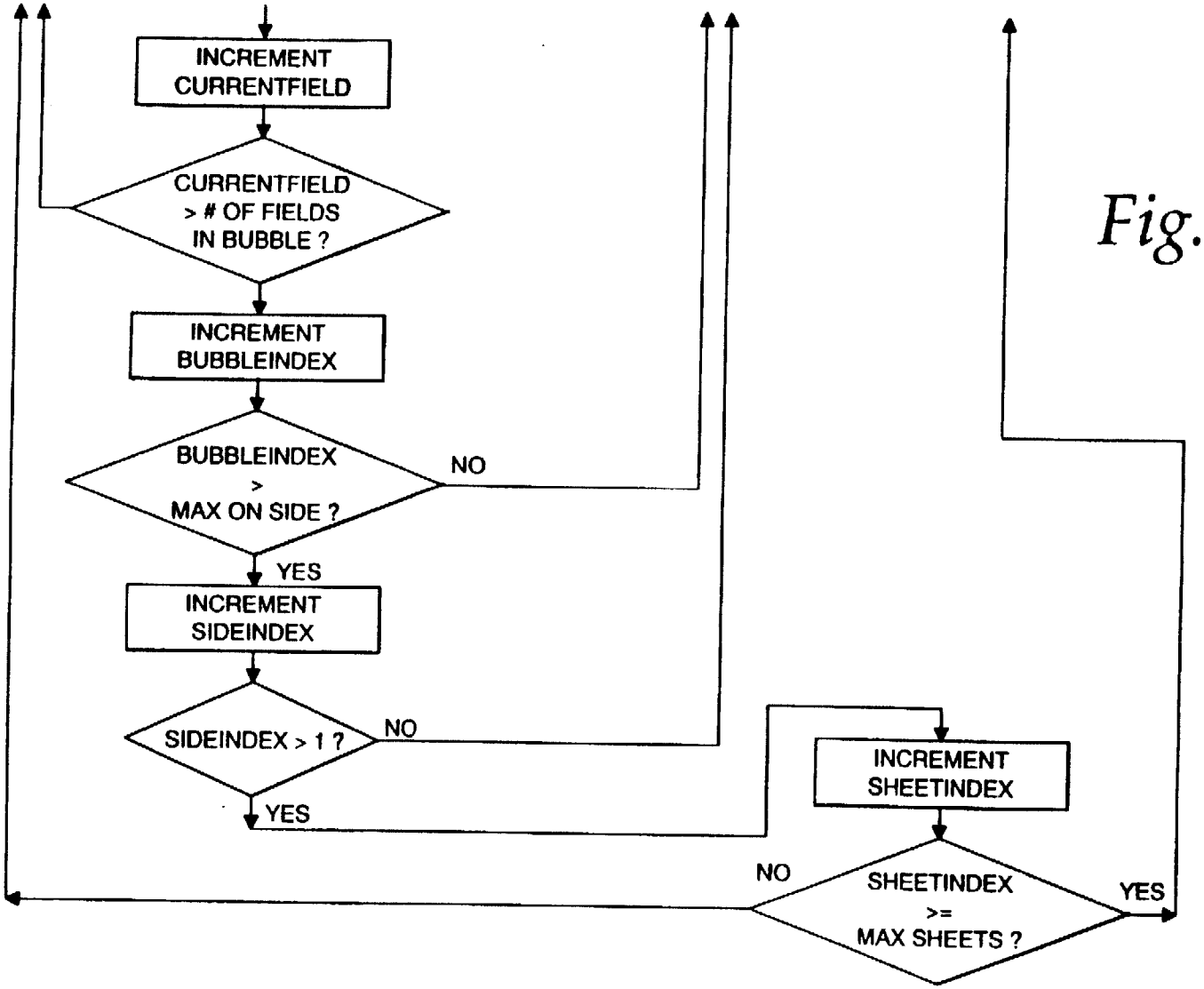

FIGS. 18 and 19 illustrate this process. Initially, the custom data file is read in and pre-processing is done as discussed with regard to FIG. 3. The Load and Pre-process Configuration routine 20 also reads the number of fields and the maximum field widths for fields in text displays 8. Instead of merging the variable data file, the Validate Custom Field Lengths for Each Bubble routine 84 is run. This routine, illustrated in FIG. 19 opens an Invalid Custom Field Report file 90 to store its output. For each field in each bubble, side and sheet, the routine determines whether the field in its current font is wider than the maximum allowable length. If it is, then a report is sent to file 90 identifying the sheet, side, bubble and variable field. It should be noted that this routine can be run either as part of the actual formatting or separate from the formatting entirely.

Although the customization software of the invention has been described above with reference to the creation of comic books, it may be used to generate any other customized printed novelties containing printed fixed and variable text within regions of various sizes and shapes, such as illustrated story books or posters in which it is desired to associate customized text with a particular character or piece of artwork.

Other embodiments of the claimed invention will be apparent to those skilled in the art from consideration of the specification and practice of the invention disclosed herein. Thus, it is to be understood that, within the scope of the appended claims, the invention may be produced otherwise than as specifically described above what is claimed and desired to be secured by a Letters Patent of the United States is:

What is claimed is:

1. A method for generating customized printed materials containing fixed text and variable text located within one or more defined regions on a page, the method comprising the steps of:

storing the fixed and variable text to be printed in each defined region in a memory device;

providing stock containing defined regions within which said fixed and variable text is to be printed, said defined regions sized to accommodate one or more lines of a predetermined maximum line length of the fixed and variable text to be printed therein;

storing the information corresponding to the location, size and shape of each defined region in a memory device;

defining a reference point for one or more defined regions and each page;

merging the variable text and fixed text to be included in each defined region to create integrated text;

formatting the integrated text to be printed in each defined region relative to said one or more reference points according to the size and shape of said regions as a function of the line length of the integrated text relative to the predetermined maximum line length and number of lines for each defined region; and printing said integrated text in said defined regions as a function of a predetermined offset relative to one or more of said reference points.

2. The method as recited in claim 1, further including the step of shifting the printing of said integrated text by varying said predetermined offset from said reference point for said page.

3. A system for generating customized printed materials containing fixed text and variable text located within one or more defined regions on a page, the system comprising:

a memory device for storing fixed and variable text to be printed in each defined region on a page, said memory storage device also for storing information corresponding to the location, size and shape of each defined region on said page;

means for merging the fixed text and variable text to be included in each defined region to create integrated text;

means for formatting the integrated text to be printed in each defined region relative to one or more reference points for each page according to the size and shape of said regions as a function of the line length of the integrated text; and means for printing said integrated text in said defined regions as a function of a predetermined offset relative to one or more of said reference points.

4. The system as recited in claim 3, further including means for shifting said printing on said page by a predetermined offset relative to said reference point for said page.

* * * * *